US007656099B2

(12) United States Patent
Hirschmann et al.

(10) Patent No.: US 7,656,099 B2
(45) Date of Patent: Feb. 2, 2010

(54) CIRCUIT ARRANGEMENT FOR OPERATING HIGH-PRESSURE DISCHARGE LAMPS AND OPERATING METHOD FOR A HIGH-PRESSURE DISCHARGE LAMP

(75) Inventors: Günther Hirschmann, Müchen (DE); Daniel Lerchegger, München (DE); Bernhard Sieβegger, Müchen (DE)

(73) Assignee: Patent-Treuhand-Gesellschaft fur elektrische Gluhlampen mbH, Munich (DE)

( * ) Notice: Subject to any disclaimer, the term of this patent is extended or adjusted under 35 U.S.C. 154(b) by 546 days.

(21) Appl. No.: 10/594,875

(22) PCT Filed: Apr. 14, 2005

(86) PCT No.: PCT/DE2005/000685

§ 371 (c)(1),
(2), (4) Date: Sep. 29, 2006

(87) PCT Pub. No.: WO2005/104632

PCT Pub. Date: Nov. 3, 2005

(65) Prior Publication Data

US 2007/0228997 A1 Oct. 4, 2007

(30) Foreign Application Priority Data

Apr. 26, 2004 (DE) ..... 10 2004 020 499

(51) Int. Cl.
*H05B 41/36* (2006.01)

(52) U.S. Cl. ..... 315/307; 315/209 R; 315/209 CD; 315/291; 315/224; 315/276

(58) Field of Classification Search ..... 315/274–279, 315/209 CD, 209 R, 219, 223–225, 291, 315/307
See application file for complete search history.

(56) References Cited

U.S. PATENT DOCUMENTS 4,683,404 A * 7/1987 Hitchcock ..... 315/276
5,124,895 A * 6/1992 Segoshi et al. ..... 362/265
5,491,386 A * 2/1996 Eriguchi et al. ..... 315/209 R
5,861,718 A * 1/1999 Pruett ..... 315/209 CD
5,990,633 A 11/1999 Hirschmann et al.

(Continued)

FOREIGN PATENT DOCUMENTS

DE 40 32 292 A1 5/1991

(Continued)

OTHER PUBLICATIONS

Gulko & Yaakov, "A MHz Electronic Ballast for Automotive-Type HID Lamps", IEEE Power Electronics Specialists Conference, PESC-97, pp. 39-45, St. Louis, 1997.

*Primary Examiner*—Douglas W Owens
*Assistant Examiner*—Ephrem Alemu
(74) *Attorney, Agent, or Firm*—Frishauf, Holtz, Goodman & Chick, P.C.

(57) ABSTRACT

The invention relates to a circuit arrangement for operating high pressure discharge lamps and corresponding operating method, whereby the input voltage for the pulsed trigger device is increased by means of a series resonance loop (L3, C4), of a cascade circuit, or a symmetrical voltage doubling circuit.

11 Claims, 5 Drawing Sheets

U.S. PATENT DOCUMENTS

Figure 1:
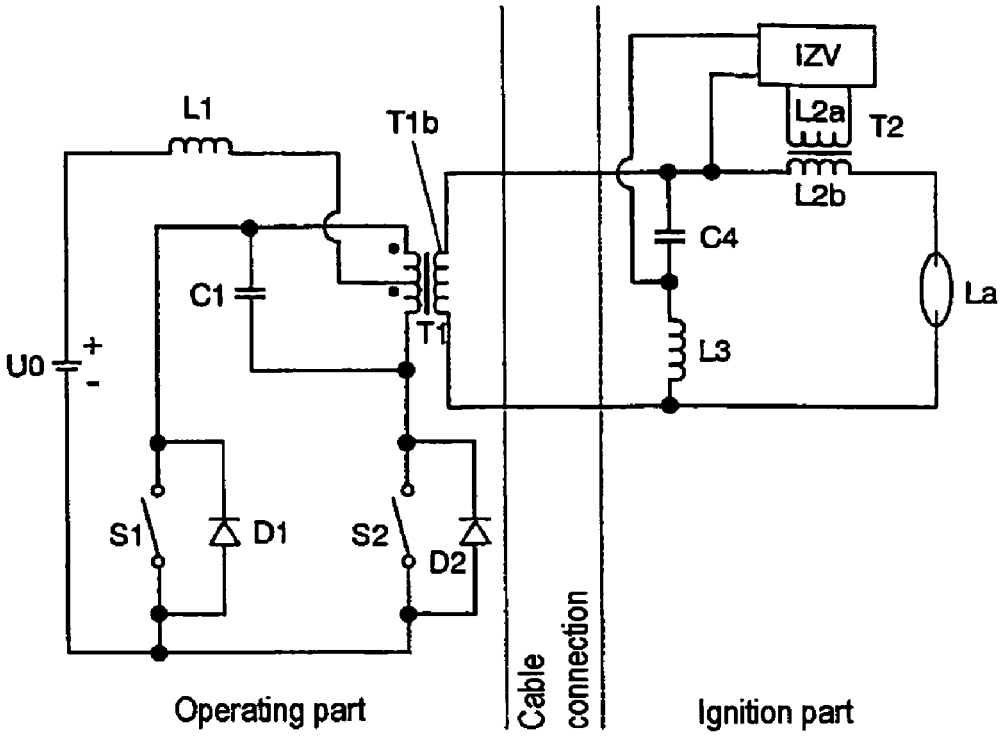

| | | | | |
|---|---|---|---|---|
| 6,124,682 | A * | 9/2000 | Lakin et al. | 315/291 |
| 6,194,844 | B1 | 2/2001 | Rupp et al. | |
| 6,392,363 | B1 * | 5/2002 | Decker | 315/291 |
| 7,042,169 | B2 * | 5/2006 | Neumeier et al. | 315/276 |
| 7,084,580 | B2 * | 8/2006 | Muramatsu et al. | 315/219 |
| 2005/0057181 | A1 * | 3/2005 | Izumi et al. | 315/209 R |
| 2005/0179406 | A1 * | 8/2005 | Harada et al. | 315/291 |
| 2005/0212457 | A1 * | 9/2005 | Klipstein et al. | 315/291 |

FOREIGN PATENT DOCUMENTS

| | | | |
|---|---|---|---|
| DE | 199 09 530 | A1 | 1/2001 |
| FR | 2 686 762 | A1 | 7/1993 |
| FR | 2 698 515 | A1 | 5/1994 |
| JP | 169584 | | 7/1995 |
| JP | 272879 | | 10/1995 |
| WO | WO 95/28071 | A1 | 10/1995 |
| WO | 98/18297 | A1 | 4/1998 |

* cited by examiner

CIRCUIT ARRANGEMENT FOR OPERATING HIGH-PRESSURE DISCHARGE LAMPS AND OPERATING METHOD FOR A HIGH-PRESSURE DISCHARGE LAMP

This application is a U.S. National Phase Application under 35 USC 371 of International Application PCT/DE2005/000685, filed Apr. 14, 2005.

The invention relates to a circuit arrangement for operating high-pressure discharge lamps in accordance with the pre-characterizing clause of patent claim 1, to a pulse ignition apparatus and a high-pressure discharge lamp having a pulse ignition apparatus and to a method for operating a high-pressure discharge lamp.

I. PRIOR ART

Such a circuit arrangement is described, for example, in the article by Michael Gulko and Sam Ben-Yaakov "A MHz Electronic Ballast for Automotive-Type HID Lamps" IEEE Power Electronics Specialists Conference, PESC-97, pages 39-45, St. Louis, 1997. This publication discloses a current-fed push-pull converter, which applies a high-frequency AC voltage via a transformer to a load circuit, in which a high-pressure discharge lamp is connected. In addition, the secondary winding of the ignition transformer of an ignition apparatus is connected into the load circuit and generates the ignition voltage for igniting the gas discharge in the high-pressure discharge lamp.

The laid-open specification WO 98/18297 describes a push-pull converter, which applies a high-frequency AC voltage via a transformer to a load circuit and to a pulse ignition apparatus which is DC-isolated therefrom. A high-pressure discharge lamp is connected into the load circuit. The pulse ignition apparatus supplies high-voltage pulses to an auxiliary ignition electrode of the high-pressure discharge lamp during the ignition phase.

II. DESCRIPTION OF THE INVENTION

The object of the invention is to provide a generic circuit arrangement having improved voltage supply for the pulse ignition apparatus.

In addition, the circuit arrangement according to the invention is intended to ensure high-frequency operation of the high-pressure discharge lamp at AC voltages in the megahertz range and reliable ignition of the gas discharge in the lamp.

This object is achieved according to the invention by the features of patent claim 1. Particularly advantageous embodiments of the invention are described in the dependent patent claims.

The circuit arrangement according to the invention for operating high-pressure discharge lamps has a voltage converter for generating an AC voltage and a transformer, which is connected thereto or is formed as part of the voltage converter and whose secondary winding feeds a load circuit, which is provided with terminals for a high-pressure discharge lamp and for the ignition voltage output of a pulse ignition apparatus, and has a series resonant circuit, which is provided for supplying voltage to the pulse ignition apparatus during the ignition phase of the high-pressure discharge lamp. During the ignition phase of the high-pressure discharge lamp, a magnified supply voltage, which is generated from the output voltage of the voltage converter, is provided at the voltage input of the pulse ignition apparatus by means of the abovementioned series resonant circuit. Owing to the magnification of the supply voltage brought about by the series resonant circuit, it is possible for an ignition transformer having a lower turns ratio between the secondary winding and the primary winding and a correspondingly reduced inductance to be used for the pulse ignition apparatus in order to provide the required ignition voltage for the high-pressure discharge lamp. In particular at operating frequencies far above 100 kilohertz, the reduced inductance of the ignition transformer has the advantage that, once the gas discharge in the high-pressure discharge lamp has been ignited, a considerably reduced voltage drop across the secondary winding, through which the lamp current flows, of the ignition transformer occurs and, as a result, the losses in the transformer at the voltage output of the voltage converter and in the electronic components of the voltage converter are considerably reduced. The abovementioned series resonant circuit therefore allows for the combination of a voltage converter, which is designed for comparatively high operating frequencies markedly above 100 kilohertz, with a pulse ignition apparatus, whose ignition transformer is connected directly in the load circuit supplied by the voltage converter and which does not need to be arranged such that it is DC-isolated from the load circuit, as described in the laid-open specification WO 98/18297. As a result, the topology of the circuit arrangement can be considerably simplified. In particular, it is possible to dispense with an auxiliary ignition electrode in the case of the high-pressure discharge lamp. Particularly advantageously, the invention can be applied to a single-stage voltage converter, in particular a voltage converter in the form of a current-fed push-pull converter or in the form of a Class E converter, which dispenses with the generation of an intermediate circuit voltage. The circuit topology of this abovementioned single-stage voltage converter is comparatively simple and therefore cost-effective.

In accordance with one preferred variant of the invention, the abovementioned series resonant circuit is connected to the secondary winding of the transformer and, when a high-pressure discharge lamp is connected, is connected in parallel with the discharge path of the high-pressure discharge lamp. As a result, a higher voltage for the pulse ignition apparatus is generated at the components of the series resonant circuit than in the secondary winding of the transformer if the switching frequency of the voltage converter is in the vicinity of the resonant frequency of the series resonant circuit during the ignition phase of the high-pressure discharge lamp. Once the ignition phase has ended, the series resonant circuit is short-circuited by the now conductive discharge path of the high-pressure discharge lamp and, as a result, the pulse ignition apparatus is deactivated.

In accordance with another preferred variant of the invention, the series resonant circuit is connected into the voltage converter on the primary side of the transformer. For this purpose, the resonant inductance of the series resonant circuit is preferably in the form of an autotransformer, whose secondary winding can be connected to the voltage input of a pulse ignition apparatus. The deactivation of the pulse ignition apparatus once the ignition phase of the high-pressure discharge lamp has ended can in this case be brought about in a simple manner by changing, preferably increasing, the switching frequency of the voltage converter. During the ignition phase, the switching frequency of the voltage converter is in the vicinity of the resonant frequency of the series resonant circuit.

In order to further reduce the power loss in the circuit arrangement, a capacitor is advantageously arranged in the load circuit and is connected in series with the secondary winding of the ignition transformer when the pulse ignition apparatus is connected, and its capacitance is dimensioned such that it essentially represents a short circuit for the ignition pulses generated by the pulse ignition apparatus and, once the gas discharge in the high-pressure discharge lamp has been ignited, brings about partial compensation of the inductance of the ignition transformer through which the lamp current flows. This capacitor can advantageously also be formed as part of the series resonant circuit.

In accordance with one advantageous embodiment of the invention, the series resonant circuit is formed as part of a pulse ignition apparatus which is accommodated in the lamp base of the high-pressure discharge lamp, separately from the remaining components of the operating device of the high-pressure discharge lamp. As a result, all components carrying a high voltage are arranged in the lamp base, with the result that the interface between the operating device, which contains the voltage converter with the transformer at its voltage output, and the high-pressure discharge lamp is only subjected to a comparatively low voltage of less than 100 volts. This interface therefore does not require any high-voltage insulation, but only requires shielding of the high-frequency AC voltage in order to ensure sufficient electromagnetic compatibility of the operating device and the lamp. For example, this is achieved in a known manner by means of grounded, metallic housings or shieldings and coaxial cables, whose shielding braid is likewise grounded.

In addition to the usual components, the pulse ignition apparatus according to the invention therefore also has a series resonant circuit, which is connected to its voltage input and is used for magnification of the supply voltage provided at the voltage input during the ignition phase.

As an alternative or in addition to the abovementioned series resonant circuit, it is also possible for a voltage-multiplying cascade circuit to be used in the circuit arrangement or pulse ignition apparatus in order to provide a higher input voltage than the induced voltage generated by the secondary winding of the transformer for the pulse ignition apparatus. In combination with the voltage converter, it offers similar advantages to the above-described series resonant circuit. However, the variant with the series resonant circuit has the advantage over that with the cascade circuit that it does not require any switching means for deactivating the pulse ignition apparatus.

The voltage-multiplying cascade circuit is advantageously supplied with energy either directly from the voltage converter or from the secondary winding of the transformer at the voltage output of the push-pull converter. If the voltage-multiplying cascade circuit is used in combination with the series resonant circuit, the voltage input of the cascade circuit is connected in parallel with a resonant circuit component and its voltage output is connected to the voltage input of the pulse ignition apparatus.

In accordance with one further variant of the invention, as an alternative to the above-described voltage-multiplying cascade circuit it is possible for a symmetrical voltage-doubling circuit to be used in the circuit arrangement or pulse ignition apparatus in order to provide a higher input voltage than the induced voltage generated by the secondary winding of the transformer for the pulse ignition apparatus. In combination, it offers similar advantages to the above-described cascade circuit if voltage-doubling is sufficient. This symmetrical voltage-doubling circuit can also be used in combination with the above-described series resonant circuit. The symmetrical voltage-doubling circuit has the advantage of an approximately symmetrical current consumption during the positive and negative half-cycle of the supply voltage and avoids asymmetrical magnetic saturation of the core of the transformer at the voltage output of the voltage converter.

The symmetrical voltage-doubling circuit is advantageously supplied with energy either directly by the voltage converter or by the secondary winding of the transformer at the voltage output of the push-pull converter. If the symmetrical voltage-doubling circuit is used in combination with the series resonant circuit, the voltage input of the symmetrical voltage-doubling circuit is connected in parallel with a resonant circuit component and its voltage output is connected to the voltage input of the pulse ignition apparatus.

The method according to the invention for operating a high-pressure discharge lamp by means of a voltage converter and a pulse ignition apparatus is characterized by the fact that, during the ignition phase of the high-pressure discharge lamp, an increase in the supply voltage for the pulse ignition apparatus is carried out with the aid of a series resonant circuit, which is operated close to its resonant frequency, and/or by means of a voltage-multiplying cascade circuit.

The operating mode according to the invention allows for reliable high-frequency operation of the high-pressure discharge lamp at AC frequencies which are far above the acoustic resonances of the discharge medium within the high-pressure discharge lamp. In particular, the operating mode according to the invention can ensure that, on the one hand, during the ignition phase of the high-pressure discharge lamp a sufficiently high ignition voltage is generated and, on the other hand, once the ignition phase has ended during lamp operation, the secondary winding, through which the high-frequency lamp current flows, of the ignition transformer does not bring about any unreasonably high power losses in the circuit arrangement.

During the ignition phase of the high-pressure discharge lamp, the voltage converter is advantageously operated at a switching frequency close to the resonant frequency of the series resonant circuit in order to provide a magnified supply voltage for the pulse ignition apparatus. Once the ignition phase has ended, the switching frequency of the switching means of the voltage converter is preferably displaced to a frequency markedly above the resonant frequency of the series resonant circuit in order, as a result, to deactivate the pulse ignition apparatus.

III. DESCRIPTION OF THE PREFERRED EXEMPLARY EMBODIMENTS

Figure 2:
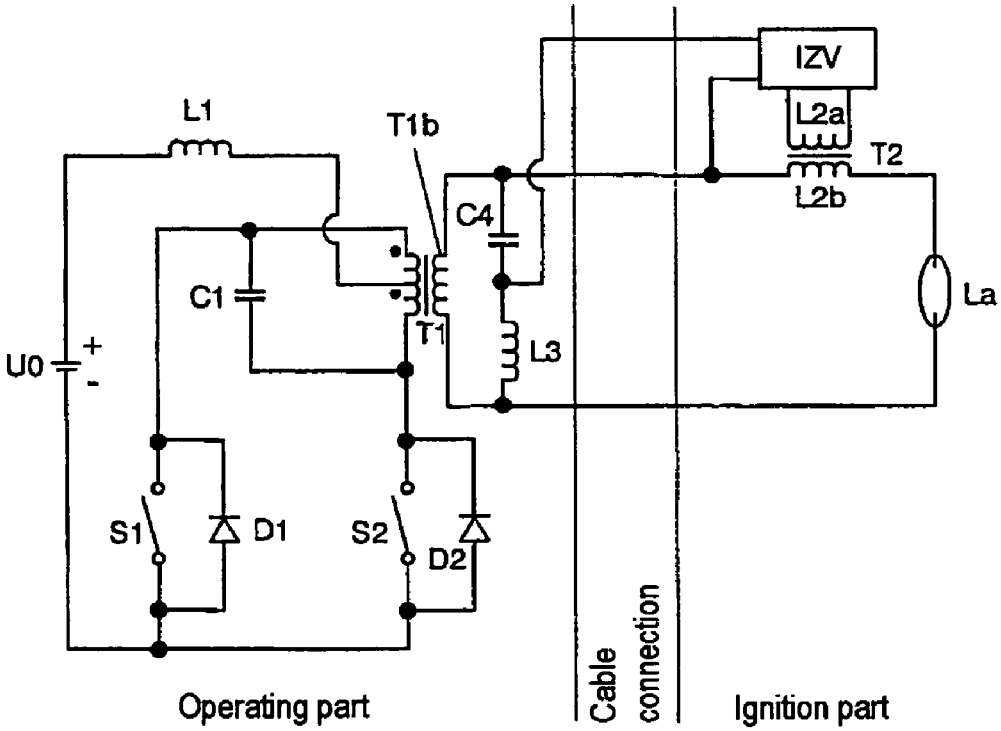
Figure 3:
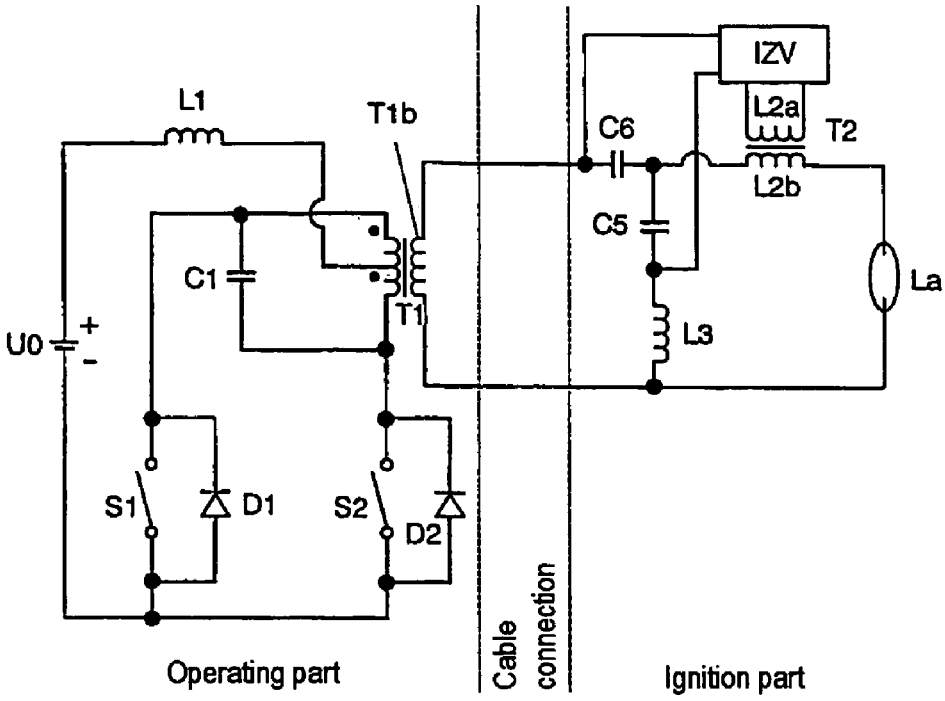
Figure 4:
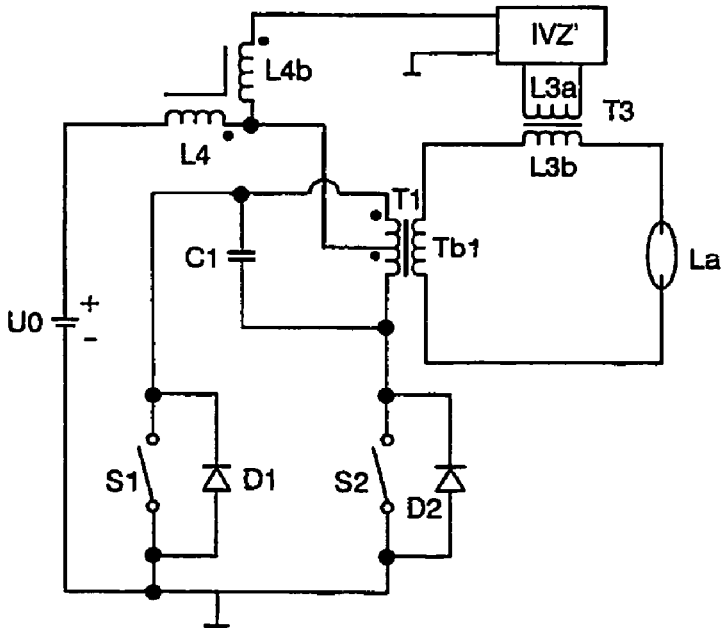
Figure 5:
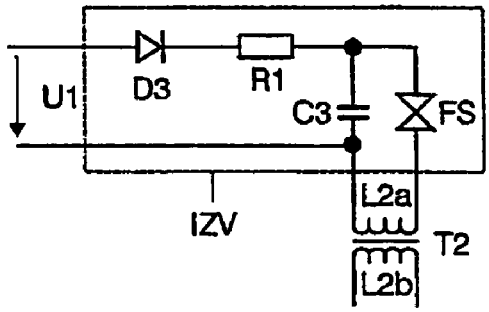
Figure 6:
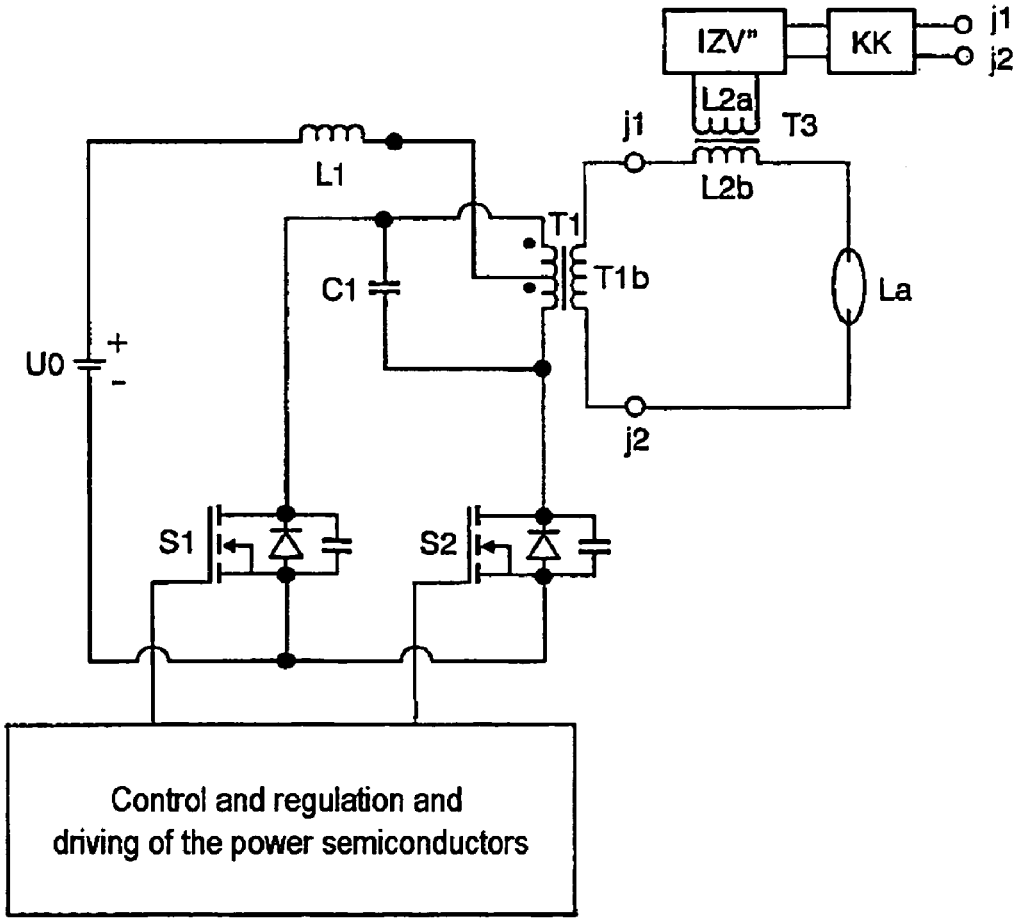
Figure 7:
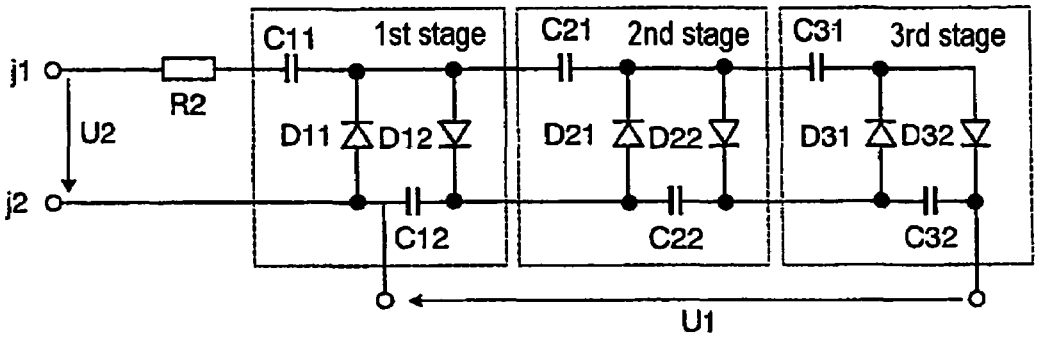
Figure 8:
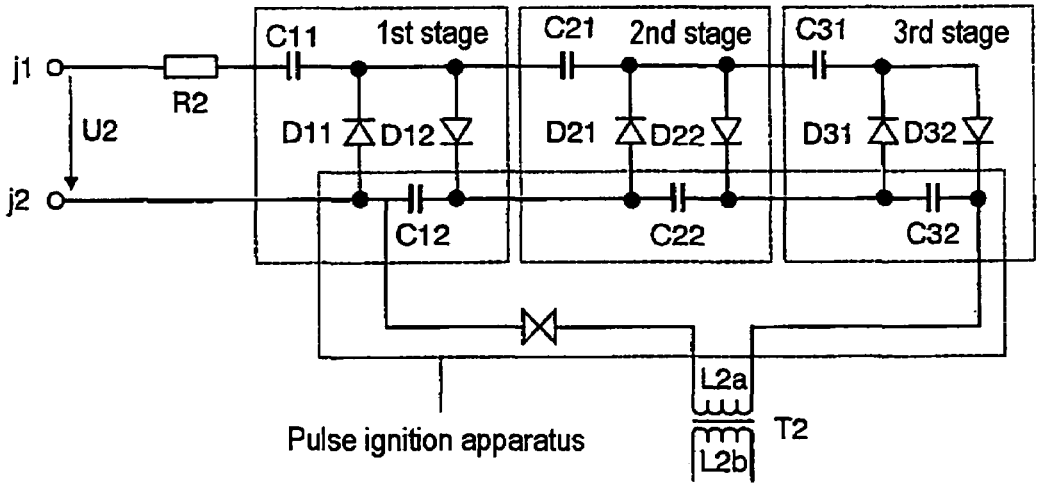
Figure 9:
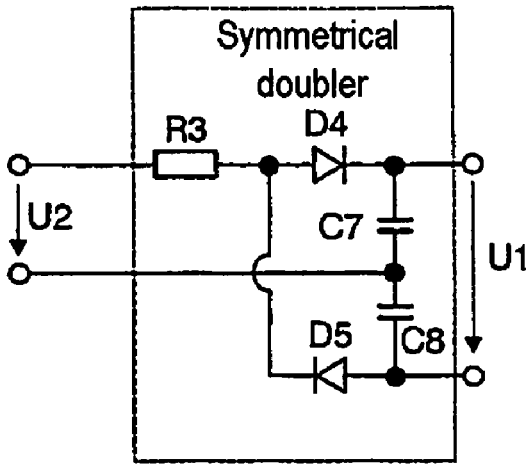
Figure 10:
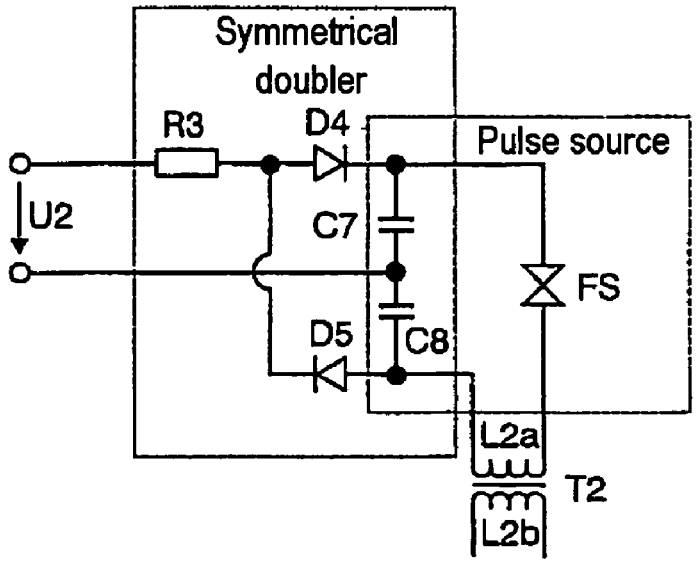

The invention will be explained in more detail below with reference to a few preferred exemplary embodiments. In the drawings:

FIG. 1 shows a circuit diagram of the circuit arrangement in accordance with a first exemplary embodiment of the invention, FIG. 2 shows a circuit diagram of the circuit arrangement in accordance with a second exemplary embodiment of the invention, FIG. 3 shows a circuit diagram of the circuit arrangement in accordance with a third exemplary embodiment of the invention, FIG. 4 shows a circuit diagram of the circuit arrangement in accordance with a fourth exemplary embodiment of the invention, FIG. 5 shows a circuit diagram of the pulse ignition apparatus for the first to fourth exemplary embodiments, FIG. 6 shows a circuit diagram of the circuit arrangement in accordance with the fifth to eighth exemplary embodiments of the invention, FIG. 7 shows a circuit diagram of a cascade circuit for supplying the pulse ignition apparatus of the fifth exemplary embodiment depicted in FIG. 6, FIG. 8 shows a circuit diagram of a combination of the cascade circuit with the pulse ignition apparatus for the fifth exemplary embodiment depicted in FIG. 6, FIG. 9 shows a circuit diagram of a symmetrical voltage-doubling circuit for supplying the pulse ignition apparatus of the sixth exemplary embodiment depicted in FIG. 6, and FIG. 10 shows a circuit diagram of a combination of the symmetrical voltage-doubling circuit with the pulse ignition apparatus for the sixth exemplary embodiment depicted in FIG. 6.

The exemplary embodiments of the invention depicted in FIGS. 1 to 8 are circuit arrangements and pulse ignition apparatuses for operating a mercury-free halogen metal vapor high-pressure discharge lamp having an electrical power consumption of approximately 35 watts, which is envisaged for use in the headlamp of a motor vehicle.

FIG. 1 depicts a first exemplary embodiment of a circuit arrangement according to the invention for operating the abovementioned mercury-free halogen metal vapor high-pressure discharge lamp. In addition, a pulse ignition apparatus for igniting the gas discharge in the mercury-free halogen metal vapor high-pressure discharge lamp which is accommodated in the lamp base is also depicted. The circuit arrangement comprises a DC voltage source U0, which is formed by the battery or generator of the motor vehicle, and an inductor L1, a capacitor C1, two controllable semiconductor switches S1, S2, each having a diode D1 and D2, respectively, connected in parallel therewith, and a transformer T1 having two primary windings and one secondary winding. The switches S1, S2 are in the form of field-effect transistors (MOSFETs) and the diodes D1 and D2 are the so-called body diodes integrated in the field-effect transistors S1 and S2, respectively. The inductor L1, the capacitor C1, the semiconductor switches S1, S2 with their diodes D1, D2 and the transformer T1 are interconnected in the form of a current-fed push-pull converter, as is described in the above-cited prior art. With the aid of the inductor L1, an approximately constant current is impressed at the center tap M1 between the two primary windings, having the same polarity, of the transformer T1. The semiconductor switches S1, S2 switch alternately, with the result that one of the two switches S1, S2 is always closed. The abovementioned components of the circuit arrangement form the operating part for the lamp, which is arranged in a housing, separately from the lamp. A load circuit is connected to the secondary winding of the transformer T1 and is equipped with terminals for the mercury-free halogen metal vapor high-pressure discharge lamp La and the pulse ignition apparatus. The pulse ignition apparatus IZV comprises an ignition transformer T2, whose secondary winding L2*b* is connected into the load circuit. A series resonant circuit, which comprises the resonant inductance L3 and the resonant capacitor C4, is connected in parallel with the secondary winding of the transformer T1, which forms the voltage output of the current-fed push-pull converter. The voltage input of the pulse ignition apparatus IZV is connected in parallel with the resonant capacitor C4. The series resonant circuit C4, L3 is in this case formed as part of the pulse ignition apparatus IZV and, together with this, is accommodated in the base of the mercury-free halogen metal vapor high-pressure discharge lamp La. The operating part and ignition part are in this case connected to one another via shielded coaxial cables.

The second exemplary embodiment of the invention depicted in FIG. 2 differs from the above-described first exemplary embodiment merely by the fact that the components L3, C4 of the series resonant circuit are not formed as part of the pulse ignition apparatus IZV but as part of the operating part. For this reason, the same reference symbols have been used for identical components in FIGS. 1 and 2.

The circuit arrangement in accordance with the third exemplary embodiment depicted in FIG. 3 differs from the first exemplary embodiment merely by the additional capacitor C6 and the dimensions of the capacitor C5. For this reason, the same reference symbols have been used for identical components in the exemplary embodiments in FIGS. 1 and 3. The capacitors C5, C6 and the inductance L3 together form a series resonant circuit, which supplies the pulse ignition apparatus IZV with energy during the ignition phase of the high-pressure discharge lamp La. For this purpose, the voltage input of the pulse ignition apparatus IZV is connected in parallel with the capacitors C5, C6, which are connected in series during the ignition phase of the lamp La. Once the ignition phase has ended, the components C5, L3 of the series resonant circuit which are connected in parallel with the discharge path of the high-pressure discharge lamp La are short-circuited by the now conductive discharge path of the lamp La and the switching frequency of the current-fed push-pull converter is increased to such an extent that it is close to the resonant frequency of the series resonant circuit, which is formed by the capacitor C6, which is now connected in series with the secondary winding L2*b* of the ignition transformer T2, and the above-mentioned secondary winding L2*b*. Once the ignition phase has ended, the capacitor C6 brings about partial compensation of the inductance of the secondary winding L2*b*, through which the lamp current flows, of the ignition transformer T2 during lamp operation, as a result of which the power losses in the semiconductor switches S1, S2 of the push-pull converter and in the transformer T1 are reduced.

Table 1 specifies the dimensions for the components used in the first to third exemplary embodiments. A circuit diagram of the pulse ignition apparatus IZV for the abovementioned exemplary embodiments is depicted in FIG. 5.

During the ignition phase of the high-pressure discharge lamp La, the field-effect transistors S1, S2 are switched alternately at a switching frequency of 350 kilohertz, which corresponds to the resonant frequency of the series resonant circuit L3, C4 or L3, C5, C6, by their drive apparatus (not depicted), which is, for example, in the form of a microcontroller. As a result, an AC voltage of the same frequency is generated at the secondary winding of the transformer T1, from which voltage an AC voltage, which has been magnified by resonance, of approximately 2500 volts is generated by means of the abovementioned series resonant circuit. A correspondingly high input voltage U1 is therefore available for the pulse ignition apparatus IZV at the capacitor C4 or at the series circuit comprising the capacitors C5, C6, said input voltage being sufficient for charging the ignition capacitor C3 of the pulse ignition apparatus IZV via the rectifier diode D3 and the resistor R1 to the breakthrough voltage of the spark gap FS of the pulse ignition apparatus IZV. On breakthrough of the spark gap FS, the capacitor C3 is discharged via the primary winding L2*a* of the ignition transformer T2, and high-voltage ignition pulses of up to 30 000 volts are generated in its secondary winding L2*b* for the purpose of igniting the gas discharge in the high-pressure discharge lamp La. Once the gas discharge in the high-pressure discharge lamp La has been ignited, the series resonant circuit components L3, C4 or L3, C5 are short-circuited by the now conductive discharge path of the lamp La and, as a result, the input voltage which is provided at the resonant capacitor C4 or C5 and C6 for the pulse ignition apparatus IZV is no longer sufficient for charging the ignition capacitor C3 to the breakthrough voltage of the spark gap FS. Once the gas discharge in the high-pressure discharge lamp La has been ignited, the switching frequency of the push-pull converter is raised to a mid-frequency of 550 kilohertz, and frequency modulation of the alternating current in the load circuit is carried out with a frequency deviation of 30 hertz and a modulation frequency of 500 hertz around the above-mentioned mid-frequency. During this operating phase, the so-called run-up phase or the so-called power run-up of the lamp, the lamp La is supplied an increased power in order to achieve rapid evaporation of the filling components of the discharge medium of the high-pressure discharge lamp La and therefore to achieve the full light emission of the lamp La in as short a time as possible. At the end of the abovementioned power run-up, the mid-frequency of the lamp alternating current is raised to the value of 715 kilohertz in order to ensure operation at the rated lamp power of 35 watts. The above-described frequency modulation of the lamp current serves the purpose of avoiding acoustic resonances in the discharge medium of the lamp La. Given sufficiently high AC frequencies at which acoustic resonances are no longer excited to a notable degree, it is possible to dispense with frequency modulation.

FIG. 4 depicts the circuit arrangement in accordance with a fourth exemplary embodiment of the invention. This circuit arrangement differs from the first exemplary embodiment merely by the fact that the inductor L1 in the current-fed push-pull converter has been replaced by the autotransformer L4, L4*b* and the pulse ignition apparatus IZV has been replaced by the pulse ignition apparatus IZV'. Identical components have therefore been provided with the same reference symbols in FIGS. 1 and 4. The function of the inductor L1 is taken on by the primary winding L4 of the autotransformer L4, L4*b* in the fourth exemplary embodiment. The secondary winding L4*b* of the abovementioned autotransformer has a turns number which is ten times that of the primary winding L4 and is connected to the voltage input of the pulse ignition apparatus IZV'. It supplies this pulse ignition apparatus with energy during the ignition phase of the high-pressure discharge lamp La. The inductance of the primary winding L4 is 75 μH. The pulse ignition apparatus IZV' likewise has the design illustrated in FIG. 5, but differs from the pulse ignition apparatus IZV by the dimensions of its components. The components of the pulse ignition apparatus IZV' and its ignition transformer T3 with the primary winding L3*a* and the secondary winding L3*b* are dimensioned in accordance with the figures in table 2.

During the ignition phase of the high-pressure discharge lamp La, the current-fed push-pull converter in accordance with the fourth exemplary embodiment (FIG. 4) is operated at a switching frequency of 100 kilohertz. The components L4, C1 and T1 form a series resonant circuit during the above-mentioned ignition phase, with the result that an input voltage, which is generated by means of the magnification method and is further increased corresponding to the turns ratio of the secondary winding and the primary winding of the autotransformer L4, L4*b*, of approximately 1000 volts is provided for the pulse ignition apparatus IZV' at the secondary winding L4*b*. This input voltage is sufficient for charging the ignition capacitor C3 to the breakthrough voltage of the spark gap FS and for generating high-voltage pulses by means of the ignition transformer T3 for the purpose of igniting the gas discharge in the high-pressure discharge lamp La. Once the gas discharge in the high-pressure discharge lamp La has been ignited, the switching frequency of the push-pull converter is increased, as was already the case above in the first exemplary embodiment. Owing to the increase in the switching frequency, the voltage drop across the autotransformer L4, L4*b* is no longer sufficient for charging the ignition capacitor C3 to the breakthrough voltage of the spark gap FS. The deactivation of the pulse ignition apparatus IZV' can also possibly be ensured by means of an additional switch at the end of the ignition phase, however. The operation of the high-voltage discharge lamp La after the end of its ignition phase is identical to the first exemplary embodiment.

FIG. 6 shows a schematic illustration of a circuit arrangement in accordance with the fifth to eighth exemplary embodiments. This circuit arrangement comprises a current-fed push-pull converter, which has an identical design to the first exemplary embodiment. In contrast to FIG. 1, FIG. 6 also schematically illustrates the internal design of the field-effect transistors S1, S2 with their integrated body diodes and their junction capacitance and the drive apparatus. Identical components therefore have the same reference symbols in FIGS. 1 and 6. The fifth to eighth exemplary embodiments differ from the above-described exemplary embodiments by the fact that the input voltage for the pulse ignition apparatus IZV" is not generated by means of a series resonant circuit but by means of a voltage-multiplying circuit KK. In the fifth and sixth exemplary embodiments, the circuit KK is in the form of a three-stage cascade circuit, while in the seventh and eighth exemplary embodiments it is in the form of a symmetrical voltage-doubling circuit. The input voltage U2 for the voltage-multiplying circuit KK is provided at the secondary winding of the transformer T1. The voltage input j1, j2 of the voltage-multiplying circuit KK is connected into the load circuit in parallel with the secondary winding of the transformer T1.

In accordance with the fifth exemplary embodiment of the invention, the pulse ignition apparatus IZV" has an identical design to the pulse ignition apparatus IZV illustrated in FIG. 5, and the circuit KK is in the form of a three-stage cascade circuit. Details on the three-stage cascade circuit are depicted in FIG. 7. Figures for the dimensions of the three-stage cascade circuit are listed in table 3. The output voltage U1 of the three-stage cascade circuit is supplied to the voltage input of the pulse ignition apparatus IZV". During the ignition phase of the high-pressure discharge lamp La, the push-pull converter is operated at a switching frequency of 100 kilohertz, and the three-stage cascade circuit increases the induced voltage of the secondary winding of the transformer T1 corresponding to the number of its stages and makes the input voltage U1 for the pulse ignition apparatus IZV" available at its voltage output. At the end of the ignition phase, the three-stage cascade circuit is switched off by means of a switch (not depicted), which interrupts its voltage supply. Further lamp operation takes place as was already the case in the first exemplary embodiment.

The sixth exemplary embodiment of the invention differs from the fifth exemplary embodiment merely by the fact that the pulse ignition apparatus and the three-stage cascade circuit are combined with one another. This means that components of the three-stage cascade circuit, such as the capacitors C12, C22 and C23, also at the same time form components of the pulse ignition apparatus. As a result, it is possible to make savings on components. FIG. 8 shows a schematic illustration of the design of the combination of the three-stage cascade circuit with the pulse ignition apparatus. The function of the switching arrangement and the operation of the lamp La are identical to the fifth exemplary embodiment.

In accordance with the seventh exemplary embodiment of the invention, the pulse ignition apparatus IZV" has an identical design to the pulse ignition apparatus IZV illustrated in FIG. 5, and the circuit KK is in the form of a symmetrical voltage-doubling circuit. Details on the symmetrical voltage-doubling circuit are depicted in FIG. 9. Figures for the dimensions of the symmetrical voltage-doubling circuit are listed in table 4. The output voltage U1 of the symmetrical voltage-doubling circuit is supplied to the voltage input of the pulse ignition apparatus IZV". During the ignition phase of the high-pressure discharge lamp La, the push-pull converter is operated at a switching frequency of 100 kilohertz, and the symmetrical voltage-doubling circuit doubles the induced voltage of the secondary winding of the transformer T1 and makes available the input voltage U1 for the pulse ignition apparatus IZV" at its voltage output. At the end of the ignition phase, the symmetrical voltage-doubling circuit is switched off by means of a switch (not depicted), which interrupts its voltage supply. Further lamp operation takes place as was already the case in the first exemplary embodiment.

The eighth exemplary embodiment of the invention differs from the seventh exemplary embodiment merely by the fact that the pulse ignition apparatus and the symmetrical voltage-doubling circuit are combined with one another. This means that components of the symmetrical voltage-doubling circuit, such as the capacitors C7 and C8, also at the same time form components of the pulse ignition apparatus. As a result, it is possible to make savings on components. FIG. 10 shows a schematic illustration of the design of the combination of the symmetrical voltage-doubling circuit with the pulse ignition apparatus. The function of the circuit arrangement and the operation of the lamp La are identical to the seventh exemplary embodiment.

The invention is not restricted to the exemplary embodiments described in more detail above. For example, the invention can also be applied to a pulse ignition apparatus whose ignition voltage output is envisaged to be connected to the auxiliary ignition electrode of a high-pressure discharge lamp. The voltage input of the voltage-multiplying cascade circuit and the symmetrical voltage-doubling circuit can also be connected on the primary side to the push-pull converter and do not necessarily need to be fed by the secondary winding T1*b* of the transformer T1.

TABLE 1

| Dimensions of the components of the circuit arrangements in accordance with the first to third exemplary embodiments | |
|---|---|
| C1 | 1.0 nF, FKP1 (WIMA) |
| C4 | 33 pF |
| C5 | 35 pF |
| C6 | 570 pF |
| L1 | 60 μH, 20 turns, on RM5, N49 (EPCOS) |
| L3 | 4.6 mH, EFD15, N49, 300 turns (EPCOS) |
| T1 | EFD25, N59, without air gap, secondary: 40 turns, two primary windings each having 8 turns |
| T2 | primary: 1 turn, secondary: 20 turns |
| L2b | 60 μH |
| S1 (& D1) | IRF740, power MOSFET (international rectifier) |
| S2 (& D2) | IRF740, power MOSFET (international rectifier) |
| U0 | nominal 42 volts, permissible: 30 volts to 58 volts |
| La | mercury-free halogen metal vapor high-pressure discharge lamp, rating: 35 watts, 45 volts |
| C3 | 10 nF, 2.5 kV |
| D3 | two BY505 diodes connected in series |
| FS | 2000 volts |
| R1 | 30 kiloohms |

TABLE 2

| Dimensions of the components of the pulse ignition apparatus IZV' in accordance with the fourth exemplary embodiment | |
|---|---|
| C3 | 70 nF, 1000 volts |
| D3 | BY505 |
| FS | 800 volts |
| R1 | 12 kiloohms |
| T3 | primary: 1 turn, secondary: 40 turns |
| L3b | 60 μH |

TABLE 3

| Dimensions of the components of the three-stage cascade circuit shown in figure 7 | |
|---|---|
| C11, C21, C31 | 1.0 nF, FKP1 (WIMA) |
| C12, C22, C32 | 33 nF, FKP1 (WIMA) |
| D11, D21, D31 | US1M |
| D12, D22, D32 | US1M |
| FS | 2000 volts |
| R2 | 1000 ohms |

TABLE 4

| Dimensions of the components of the symmetrical voltage-doubling circuit shown in figures 9 and 10 | |
|---|---|
| R3 | 30 000 ohms |
| D4, D5 | BY505 |
| C7, C8 | 22 nF, 1200 volts |
| FS | 2000 volts |

The invention claimed is:

1. A circuit arrangement for operating high-pressure discharge lamps, the circuit arrangement having the following features, a voltage converter (S1, S2) for generating an AC voltage, a transformer (T1) having a secondary winding (T1*b*), which is connected to the voltage converter (S1, S2) or is formed as part of the voltage converter (S1, S2), a load circuit, which is fed by the secondary winding (T1*b*) of the transformer (T1) and has terminals for a high-pressure discharge lamp (La) and the ignition voltage output of a pulse ignition apparatus (IZV), which serves the purpose of igniting the gas discharge in the high-pressure discharge lamp (La), said pulse ignition apparatus (IVZ) having an ignition capacitor (C3), a rectifier diode (D3), a resistor (R1), a spark gap (FS) and an ignition transformer (T2) with a primary winding (L2*a*) and a secondary winding (L2*b*), wherein during ignition phase of the high-pressure discharge lamp said ignition capacitor (C3) is charged via said rectifier diode (D3) and said resistor (R1) to the breakthrough voltage of said spark gap (FS), and on breakthrough of said spark gap (FS) the ignition capacitor (C3) is discharged via the primary winding (L2*a*) of said ignition transformer (T2), and high-voltage ignition pulses are generated in its second winding (L2*b*) for the purpose of igniting the gas discharge in the high-pressure discharge lamp (La), wherein a series resonant circuit (L3, C4) or a voltage-multiplying cascade circuit or a symmetrical voltage-doubling circuit or the combination of a series resonant circuit with a voltage-multiplying cascade circuit or a symmetrical voltage-doubling circuit is provided for supplying voltage to the pulse ignition apparatus (IZV) during the ignition phase of the high-pressure discharge lamp (La).

2. The circuit arrangement as claimed in claim 1, wherein the series resonant circuit (L3, C4) is connected to the secondary winding (T1*b*) of the transformer (T1) and, said series resonant circuit (L3, C4) is connected in parallel with the discharge path of the high-pressure discharge lamp (La).

3. The circuit arrangement as claimed in claim 1, characterized in that the series resonant circuit is connected on the primary side to the transformer (T1).

4. The circuit arrangement as claimed in claim 3, characterized in that the resonant inductance of the series resonant circuit is in the form of an autotransformer(L4 L4*b*), whose secondary winding (L4*b*)can be connected to the voltage input of a pulse ignition apparatus.

5. The circuit arrangement as claimed in claim 1, characterized in that a capacitor (C6) is arranged in the load circuit, is connected in series with the secondary winding (L2*b*) of the ignition transformer (T2) of the pulse ignition apparatus (IZV) when the pulse ignition apparatus (IZV) is connected and is dimensioned such that it essentially represents a short circuit for the ignition pulses generated by the pulse ignition apparatus (IZV) and, once the gas discharge in the high-pressure discharge lamp (La) has been ignited, brings about partial compensation of the inductance of the ignition transformer (L2*b*).

6. The circuit arrangement as claimed in claim 5, characterized in that the capacitor (C6) is formed as part of the series resonant circuit.

7. The circuit arrangement as claimed in claim 1, characterized in that the voltage-multiplying cascade circuit is supplied with energy during the ignition phase of the high-pressure discharge lamp (La) from the secondary winding (T1*b*) of the transformer (T1).

8. The circuit arrangement as claimed in claim 1, characterized in that the voltage input of the voltage-multiplying cascade circuit is connected into the voltage converter (S1, S2) on the primary side of the transformer (T1).

9. The circuit arrangement as claimed in claim 1, characterized in that the symmetrical voltage-doubling circuit is supplied with energy during the ignition phase of the high-pressure discharge lamp (La) from the secondary winding (T1*b*) of the transformer (T1).

10. The circuit arrangement as claimed in claim 1, characterized in that the voltage input of the symmetrical voltage-doubling circuit is connected into the voltage converter (S1, S2) on the primary side of the transformer (T1).

11. The circuit arrangement as claimed in claim 1, characterized in that the voltage converter (S1, S2) is in the form of a current-fed push-pull converter.

* * * * *